US005324076A

United States Patent [19]

Nieradka

[11] Patent Number: 5,324,076

[45] Date of Patent: Jun. 28, 1994

[54] CLIP BOARD WITH STORAGE DRAWER

[76] Inventor: Robert Nieradka, 1115 Piper Rd., Wilmington, Del. 19803

[21] Appl. No.: 20,740

[22] Filed: Feb. 22, 1993

[51] Int. Cl.[5] ..... B42D 3/00

[52] U.S. Cl. ..... 281/45; 281/42; 248/441.1

[58] Field of Search ..... 281/44, 45, 49, 51, 281/42; 248/441.1, 444, 451, 452; 40/904

[56] References Cited

U.S. PATENT DOCUMENTS 4,700,634 10/1987 Mills et al. ..... 248/444 X
4,765,583 8/1988 Tenner ..... 248/444
4,892,334 1/1990 Sinclair ..... 281/45
4,896,927 1/1990 Liu et al. ..... 281/45 X
5,145,141 9/1992 Hunter ..... 281/45 X

*Primary Examiner*—Mark Rosenbaum
*Assistant Examiner*—Willmon Fridie, Jr.
*Attorney, Agent, or Firm*—Charles S. Knothe

[57] ABSTRACT

A portable clipboard is provided for use by medical professionals with a latching, pullout drawer with an integral storage area for prescription pads, medical forms and writing implements. The top surface incorporates a clip to secure documents and the pullout drawer can be moved to the open position while maintaining the top surface in position for writing.

4 Claims, 5 Drawing Sheets

CLIP BOARD WITH STORAGE DRAWER

FIELD OF THE INVENTION

The present invention relates generally to a clipboard device for use by medical and other technical personnel. The device is used to provide a solid, flat surface for the preparation of written documents and provides a secure pullout drawer to house a prescription pad and writing instruments.

BACKGROUND OF INVENTION

Doctors and technical personnel use clipboards with a clamping mechanism along the top and hard writing surface to prepare documents. The primary advantage to the use of a clipboard is that it allows for a writing surface in situations that would otherwise not allow for a suitable surface for preparing written documents. Physicians and medical technicians typically require the use of a clipboard when preparing patient records, prescriptions and other medical documents. Often it is desirable to have prescription pads, record forms, etc. available during a patient visit, examination or testing period. Technicians in other fields share similar needs.

Various devices have been described in prior art incorporating clipping mechanisms and storage compartments. For example, the device described by Sinclair, U.S. Pat. No. 4,892,334, discloses a flat writing surface that is hinged along the top and lifts to reveal a storage compartment designed to transport pens, pencils, erasers, rulers and calculators.

Zalkind, U.S. Pat. No. 2,606,774, discloses a device to hold and automatically dispense sales slips or forms to the writing surface.

Liu et al., U.S. Pat. No. 4,896,927, describes a device incorporating a writing surface, clip and cover that can be rotated to cover and protect documents when not being written on or referred to.

Aimes, U.S. Pat. No. 2,805,870, discloses a device for holding a memo pad for the movable support of index cards.

Krepp, U.S. Pat. No. 5,046,760, describes a clipboard with hollow areas for storing drafting aids.

Each of these devices addresses the need for portable writing surfaces and in some cases storage of supplies, writing implements and drafting tools. The current invention goes beyond the present art to address the specific needs of the medical profession. It incorporates a surface area and clip to secure documents while also providing a secure pullout drawer to house a prescription pad and writing instruments.

SUMMARY OF THE INVENTION

This invention discloses a device that is a combination of clipboard and concealed, sliding drawer that can be used to securely store records, forms, prescription pads, etc. A concealed, latching mechanism is incorporated into the device to release the sliding drawer allowing it to open to reveal additional forms, prescription pads and writing implements. The ability to conceal the prescription pad until it is required is of prime importance. The medical professional can release the drawer and write a prescription while performing an examination at the same time he is accessing and reading the patient's medical records which are held securely on the top surface by the clip mechanism. This ability sets this device apart from those described in the prior art.

DETAILED DESCRIPTION OF THE DRAWINGS

Figure 1:
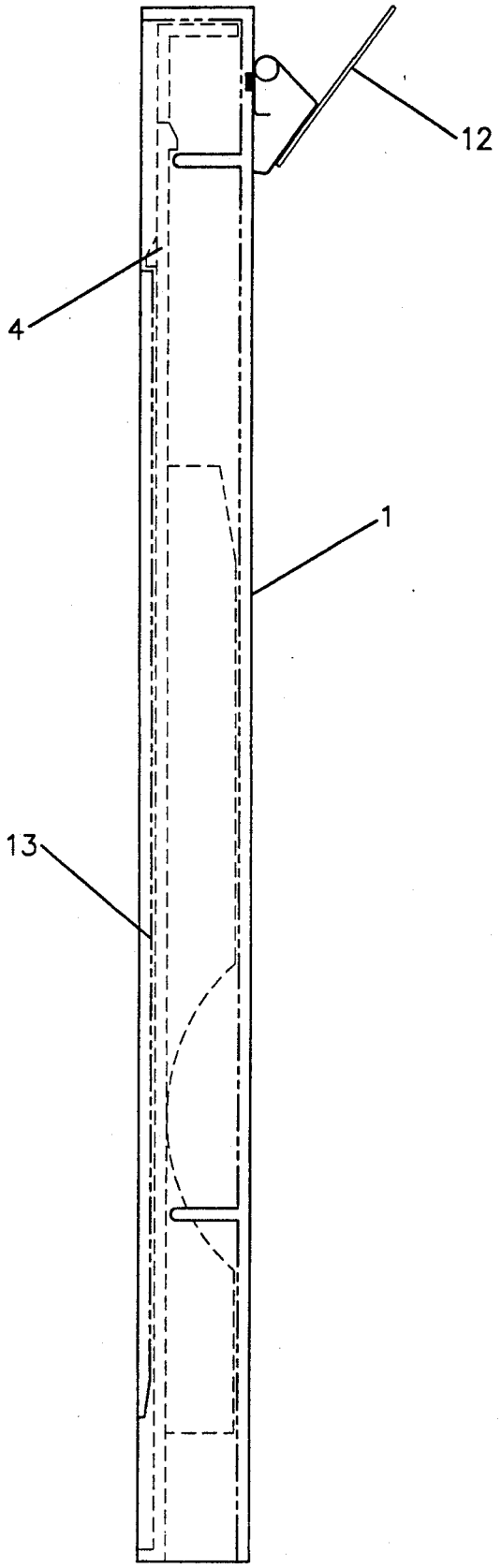
FIG. 1 is a side view of the device.

FIG. 1 is a side view of the device. In this view the drawer 4 is fully inserted in the casing 1. The clip 12 is mounted to the top surface of the casing 1 at the end opposite from the end which the draw 4 extends. The top surface of the casing is constructed of formed plastic hard enough to write upon. This surface can have an in-mold decoration or diagram placed upon it during the forming process.

Figure 2:
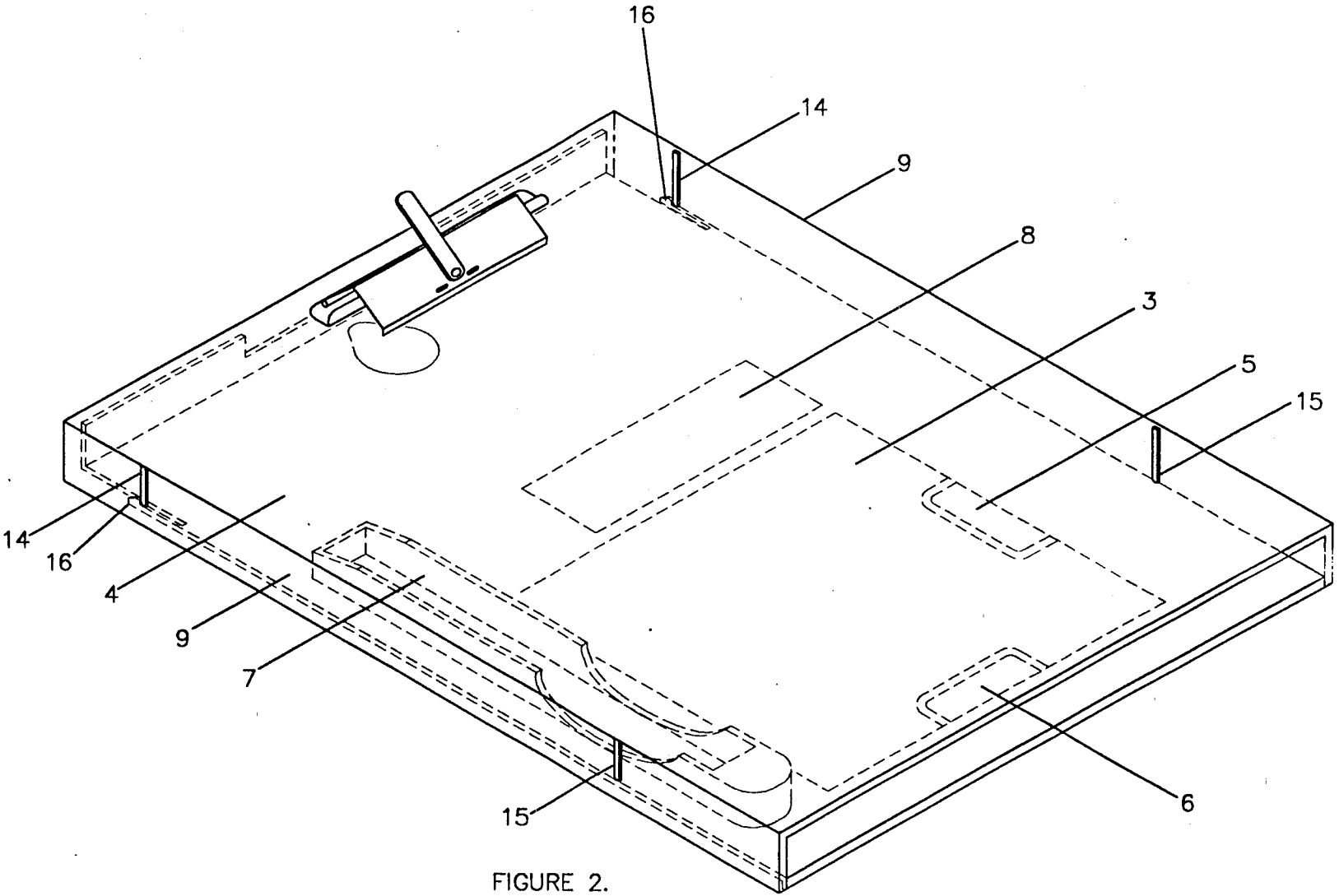
FIG. 2 is a wireframe perspective view indicating internal features.

FIG. 2 is a wireframe perspective view of the invention. In this view the drawer 4 is enclosed by the casing 1 with its two sides 9 parallel with one another and end side 12 perpendicular to the sides 9. The draw 4 slides with grooves contained in the sides 9. This figure also depicts the formed recessed panel 3 with two (2) integral tabs 5 and 6, a pencil trough 7 in the pullout drawer 4. The area 8 can be used for embossing product data or technical information.

Figure 3:
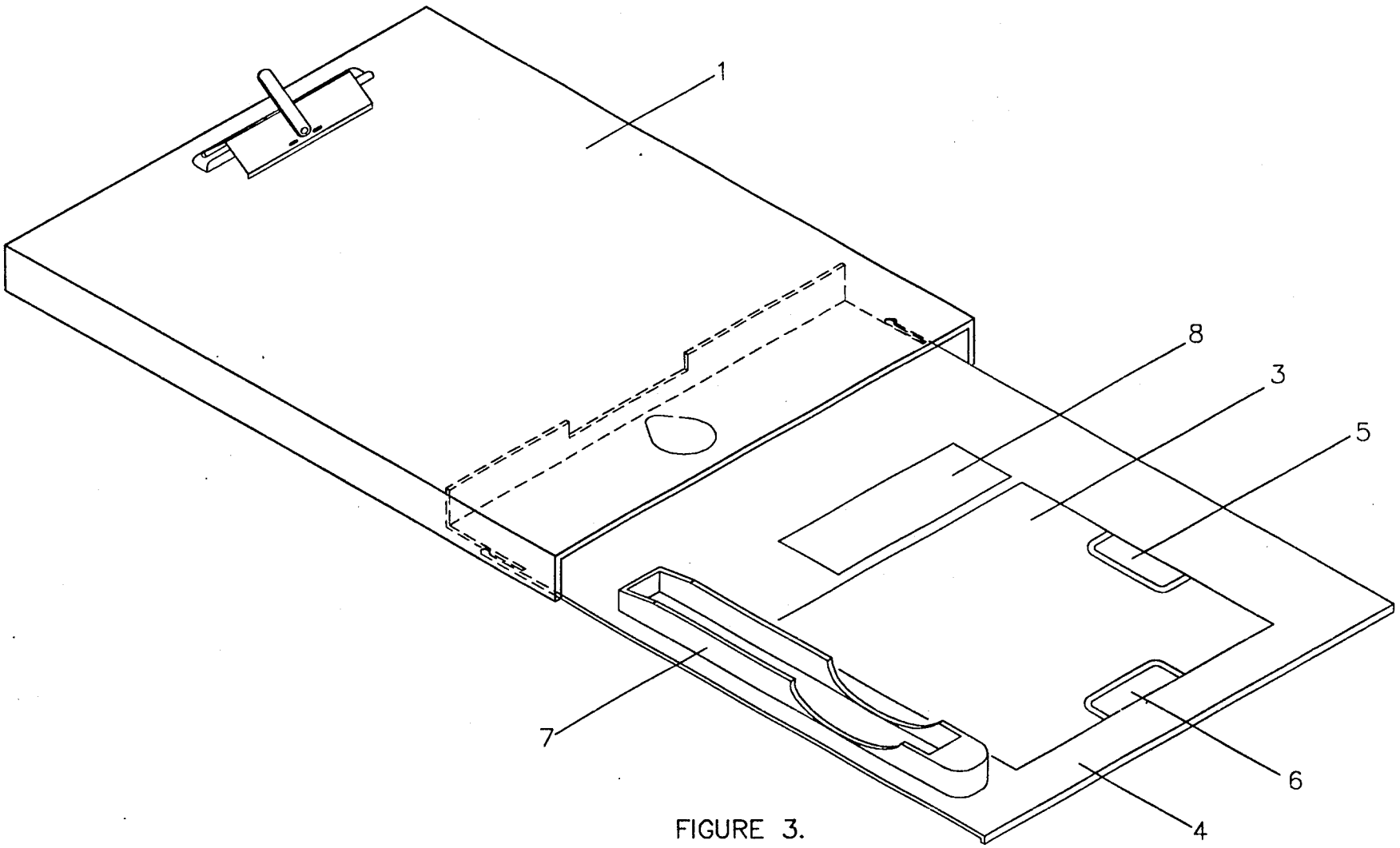
FIG. 3 is a cut-away perspective view showing the drawer in the open position.

FIG. 3 is a cut-a-way perspective view of the invention with the pullout drawer 4 extended from the casing 1. The stop 11 obstructs the draw 4 from coming out of the grooves in the sides of the casing. This view also shows the pencil trough 7, formed recessed panel 3 with tabs 5 and 6, and product identification area 8.

Figure 4:
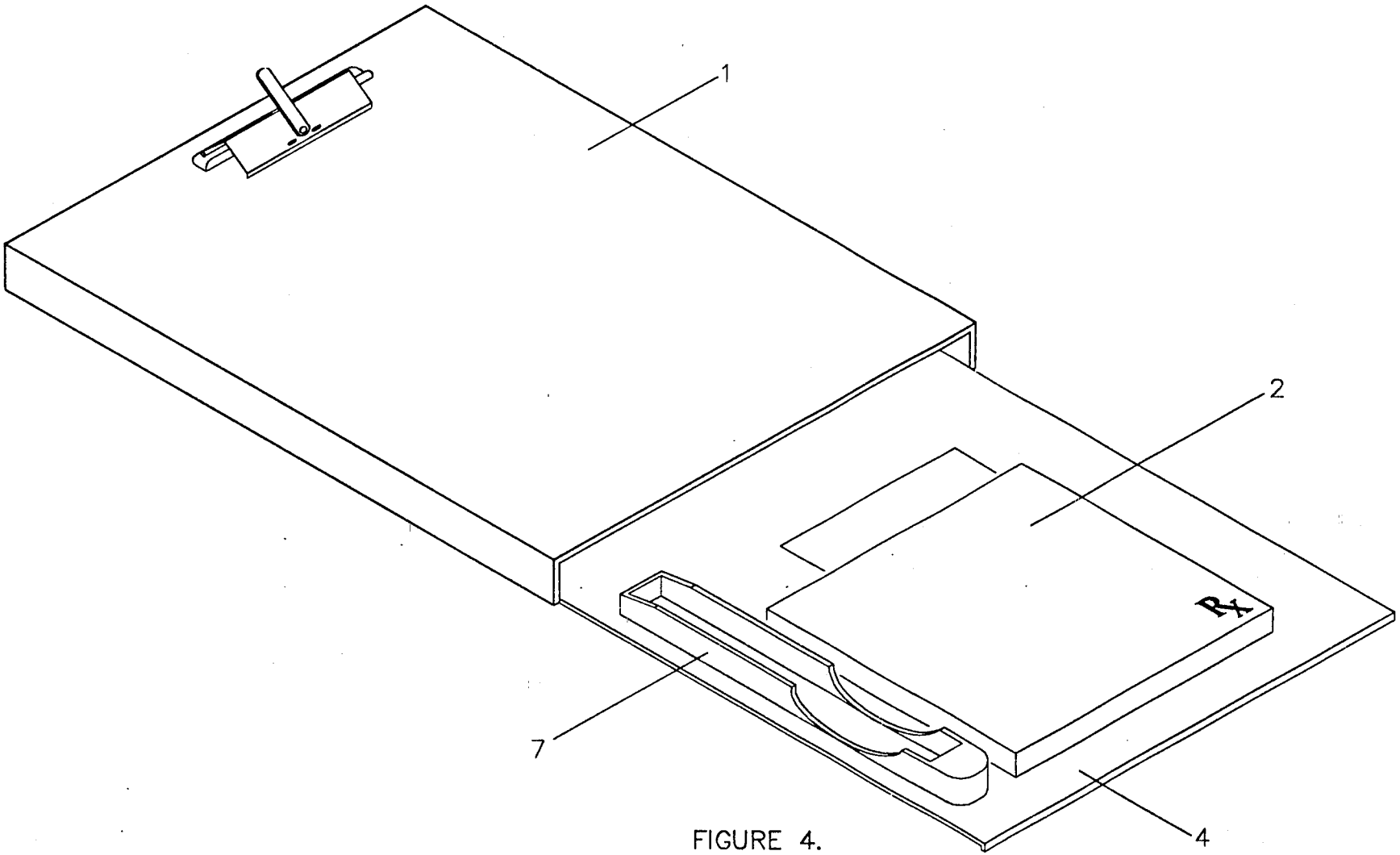
FIG. 4 is a perspective view showing the placement of a prescription pad.

FIG. 4 is a perspective view with the pullout drawer 4 extended from the casing 1, showing the pencil trough 7, prescription pad 2, and product identification area 8.

Figure 5:
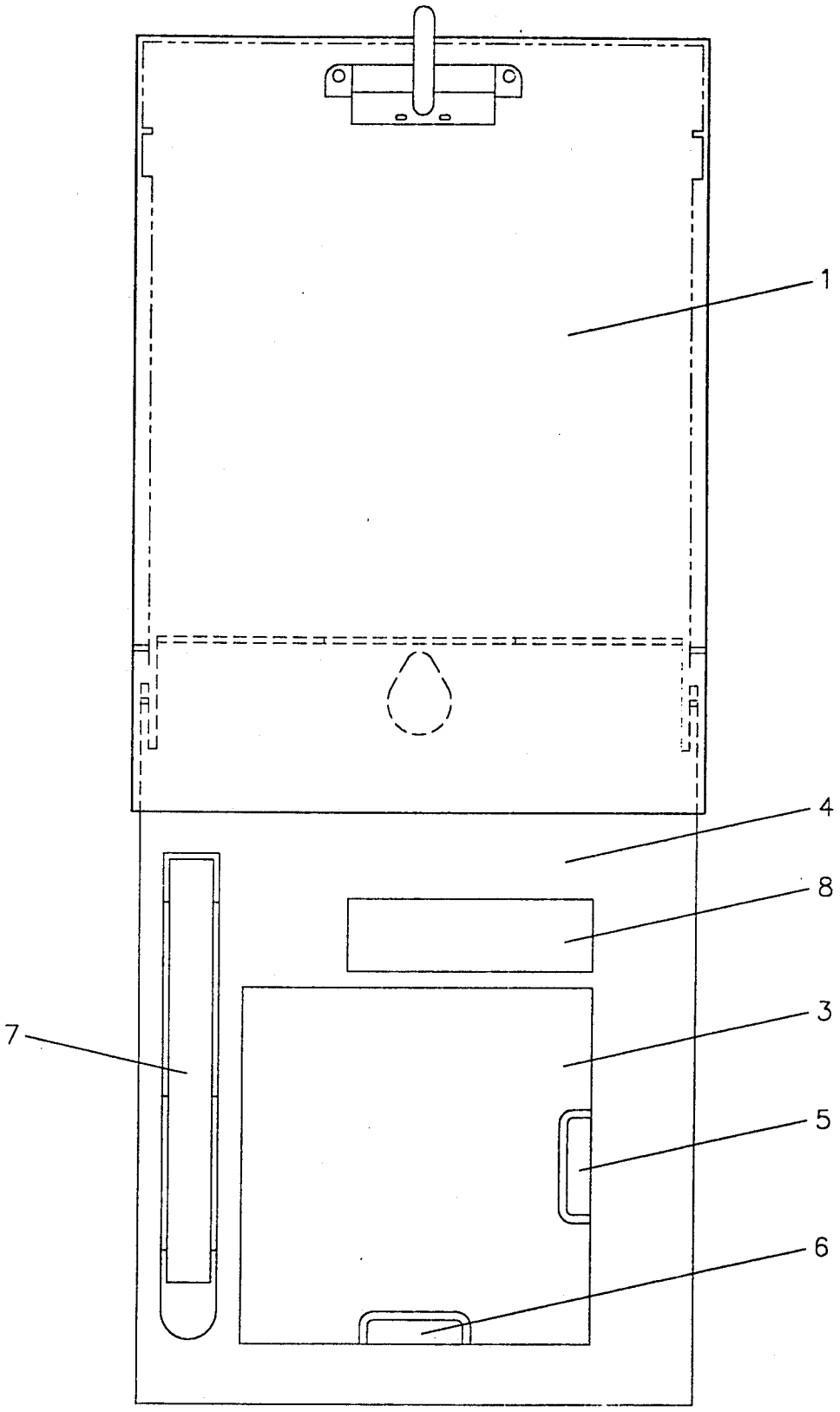
FIG. 5 is a top view with the drawer in the open position indicating the internal components.

FIG. 5 is a top view of the invention with the pullout drawer 4 extended from the casing 1, showing the pencil trough 7, formed recessed panel 3 with tabs 5 and 6, and product identification area 8.

FIG. 1 is a side view of the top casing. This view depicts the guide rails 13 upon which the drawer slides in and out. One guide rail 13 is mounted to each interior side of the top case. The two guide rails are in the same plane with one another and are parallel with one another. In FIG. 2 The drawer 4 is secured within the top case 1 by means of a latch and latch catch. Two latch catches 14 are mounted on the interior side of the case top 1 at the closed end. These two interact with the latches 16 attached to the drawer 4 as shown in. Two stop blocks 15 are mounted to the interior side of the top casing 1 at the open end. These stop blocks stop the drawer from slipping out of the top casing when the drawer is opened.

In FIG. 2 The latches 16 interact with the latch catches 14 to keep the drawer within the top case.

I claim:

1. A clipboard device for use by medical and technical personnel comprising:

a top casing having a hard, flat top surface and two formed sides perpendicular to the top surface and parallel with one another each side having an interior and exterior surface and an end side perpendicular to top surface and perpendicular to the sides;

a drawer with a bottom surface and rear lip which is perpendicular to the bottom surface of the drawer, said drawer interacts with the two sides of the top casing;

a plurality of keepers are attached to interior surface of each side of top casing and a plurality of latches are attached to the drawer which interact with the keepers to secure the drawer within the top casing;

a plurality of stop blocks are attached to the interior surface of each side of the top casing which interact with the latches to stop the drawer from sliding out of the top casing;

a clipping mechanism located at end on the top casing opposite the end the draw opens.

2. The device as in claim 1 wherein the top surface can be written on with a washable pen or erasable felt tip pen for annotations within pre-printed diagrams.

3. The device as in claim 1 wherein the drawer contains a recessed panel with a plurality of integral tabs to hold and position prescription pads.

4. The device as in claim 1 wherein the drawer contains recesses to hold writing instruments.

* * * * *